US006988283B2

(12) United States Patent
Griffin

(10) Patent No.: US 6,988,283 B2
(45) Date of Patent: Jan. 24, 2006

(54) DEEP POCKET SHEET

(76) Inventor: Jennifer Fleece Griffin, 108 Jarnigan Dr., Athens, GA (US) 30605-3622

( * ) Notice: Subject to any disclaimer, the term of this patent is extended or adjusted under 35 U.S.C. 154(b) by 0 days.

(21) Appl. No.: 10/950,077

(22) Filed: Sep. 24, 2004

(65) Prior Publication Data

US 2005/0071923 A1 Apr. 7, 2005

Related U.S. Application Data

(60) Provisional application No. 60/508,733, filed on Oct. 3, 2003.

(51) Int. Cl.
*A47G 9/02* (2006.01)

(52) U.S. Cl. ..... 5/497; 5/499

(58) Field of Classification Search ..... 5/499, 5/497, 485, 482, 483, 954
See application file for complete search history.

(56) References Cited

U.S. PATENT DOCUMENTS

| | | | | | |
|---|---|---|---|---|---|
| 924,733 | A * | 6/1909 | Carswell, Sr. | ..... | 5/497 |
| 1,732,663 | A * | 10/1929 | Schimmel | ..... | 5/499 |
| 2,151,375 | A * | 3/1939 | De Voe | ..... | 5/497 |
| 2,757,389 | A * | 8/1956 | King | ..... | 5/496 |
| 3,654,646 | A * | 4/1972 | McMahon, Jr. | ..... | 5/497 |
| 3,694,832 | A * | 10/1972 | Jamison | ..... | 5/497 |
| 4,045,831 | A * | 9/1977 | Clark | ..... | 5/497 |
| 4,525,409 | A * | 6/1985 | Elesh | ..... | 428/193 |
| 4,587,683 | A * | 5/1986 | Gardiner | ..... | 5/493 |
| 4,777,677 | A * | 10/1988 | Dugan | ..... | 5/13 |
| 4,841,588 | A * | 6/1989 | Harbin et al. | ..... | 5/494 |
| 5,092,010 | A * | 3/1992 | Wong | ..... | 5/496 |
| 5,142,718 | A * | 9/1992 | Anderson et al. | ..... | 5/497 |
| 5,454,125 | A * | 10/1995 | Ratkowski | ..... | 5/417 |
| 5,491,853 | A * | 2/1996 | Turnbull | ..... | 5/497 |
| 6,108,836 | A * | 8/2000 | Keene, III | ..... | 5/497 |
| 6,301,729 | B1 * | 10/2001 | Hall | ..... | 5/494 |
| 2005/0071923 | A1 * | 4/2005 | Griffin | ..... | 5/497 |

* cited by examiner

*Primary Examiner*—Robert G. Santos
(74) *Attorney, Agent, or Firm*—Troutman Sanders LLP; Ryan A. Schneider; James Hunt Yancey, Jr.

(57) ABSTRACT

A deep pocket sheet is disclosed having panels that envelop the bottom and top sixths to thirds of a mattress, rather than the entire mattress. The deep pocket sheet is safe, easy to construct, easy to apply and remove, and is particularly suited for use in conjunction with crib mattresses.

6 Claims, 4 Drawing Sheets

DEEP POCKET SHEET

RELATED U.S. APPLICATION DATA

This application claims priority from U.S. Provisional Application No. 60/508,733 filed 3 Oct. 2003.

BACKGROUND OF THE INVENTION

1. Field of the Invention

The present invention relates generally to a bed sheet, and more specifically to a deep pocket sheet that improves the safety of an infant.

2. Description of the Related Art

Conventional bed sheets, and in particular crib sheets, do not adequately address issues of safety. Many infants die each year from strangulation by their own bed sheets. Infants can grasp the fabric of the sheet and roll, and wrap the fabric around their rib cages or necks. In the midst of the struggle, sheets can wind even tighter. Although many young children have the ability to pull the material around them, many do not have the perception necessary to unwrap themselves. The consequences can become fatal, resulting in strangulation or suffocation.

Bed sheets may also be a contributing factor leading to Sudden Infant Death Syndrome, or SIDS. Although this syndrome is not fully understood, it is shown to be aggravated when babies breathe their own carbon dioxide-rich exhaled air, which can collect under the baby's nose, especially if the baby has become wrapped in an ill-fitted bed sheet. Regardless of the outcomes, many parents have found their own child dangerously entangled in a bed sheet.

Many conventional sheets are made from flammable material. Others have single elastic bindings that do not adequately secure and anchor the fitted sheet to the mattress. Elastic and other conventional materials used to secure a mattress can become deformed and lose their elasticity after washing. A child can pull poorly fitted sheets loose and become entrapped. Elastic can also become partially detached and can present yet another strangulation or choking hazard. Yet other designs provide for an anchoring device at the foot end of a mattress so that the head end can be removed. However, in the case of infants, any point of detachment for the fitted sheet can be potentially dangerous to the child.

Beyond these deficiencies, some conventional sheets, like an open-end pillowcase-type design, are of an impractical construction, requiring complete removal of a mattress from a crib before the sheet can be applied. Additionally, some sheets incorporate zipping devices so that the entire mattress is encased within the sheet. In this case, not only must the mattress be removed, but the sharp portions of the zipper present a hazard to the child.

It would be beneficial to provide a bed sheet, in a unitary form, that overcomes the disadvantages of known sheets, including: (a) construction from flammable or circulation-resistant material that does not allow the flow of breathable air, (b) a loose or improper fit, (c) non-secure binding mechanisms, (d) deformable and non-washable means for securing the sheet to the mattress, (e) difficulty of construction, (f) difficulty in attachment and removal of sheet from mattress without having to remove the mattress from the crib, and (g) sharp or dangerous edges or binding or securing mechanisms. What is needed, therefore, is a deep pocket sheet for covering the crib mattress that allows for safety of the infant, is cost effective, is easy and simple to use and construct, and is resilient and durable. It is to the provision of such a sheet that the present invention is primarily directed.

BRIEF SUMMARY OF THE INVENTION

The present invention is a deep pocket sheet that fits a mattress securely such that it cannot be unintentionally removed by a person laying on the surface of the mattress. In a preferred embodiment, the deep pocket sheet is designed to cover a crib mattress for an infant. The sheet has panels, or "deep pockets," that envelop the bottom and top one-sixth to one-third of a mattress, rather than the entire mattress. The deep pocket sheet is safe, especially for infants, cost effective, easy and simple to use and to construct, and resilient and durable.

The deep pocket fitted crib sheet has top and side panels made of a non-flammable, breathable material that has a vertical give in the fabric. The breathable material allows enough air circulation to alleviate any safety concern of an infant re-breathing carbon monoxide if a sheet should become wrapped around the infant. An additional strip of stretchable fabric, such as polyester, is attached to the top and bottom one-sixth to one-third of the side panels to construct deep pockets on opposing ends of the bed sheet. Alternatively, the sheet can comprise a continual, unitary panel of fleece from the top panel of the sheet. The pockets encase the head and foot of a mattress and secure the sheet underneath the sleeping surface. The edges of the deep pockets and the sides of the sheet adjacent to the deep pockets can be secured using an elastic material or suitable securing means having the ability to tighten and release, for example a cinch, drawstring, button, VELCRO™, etc.

Removal of the sheet requires only the slight elevation of the head portion and foot portion of the mattress to grasp the pocket. The vertical give in the fabric comprising the deep pocket allows for the easy removal of the sheet by pulling the sheet toward center of the mattress once the end of the mattress is elevated. This construction also prevents an infant from being able to accidentally remove the sheet by pulling, kicking, or chewing, since the average 10 to 15 pound force exerted by an infant is insufficient to elevate the mattress.

Therefore it is an object of the present invention to provide a sheet that is safer than conventional fitted sheets.

It is a further object of the present invention to provide a deep pocket sheet that fits over a mattress snugly and securely such that it cannot be removed by a child or infant.

It is another object of the present invention to provide a deep pocket sheet that is durable and withstands machine washing such that it does not lose its shape or elasticity.

Yet a further object of the present invention is to provide a deep pocket sheet that is cost-effective to manufacture.

Another object of the present invention is to provide a deep pocket sheet that can be applied to and removed from a crib mattress without removal of the mattress from the crib.

Further novel features and other objects of the present invention will become apparent from the following detailed description of the preferred embodiments, taken in conjunction with the drawings.

DETAILED DESCRIPTION OF THE INVENTION

The present invention is a deep pocket sheet having panels that envelop the bottom and top thirds of a mattress, rather than the entire mattress. The deep pocket sheet is safe, easy to construct, easy to apply and remove, and is particularly suited for use in conjunction with crib mattresses. Referring now to the Figures, in which like numerals refer to like elements throughout the several views, exemplary embodiments of the present invention are described.

Figure 1:
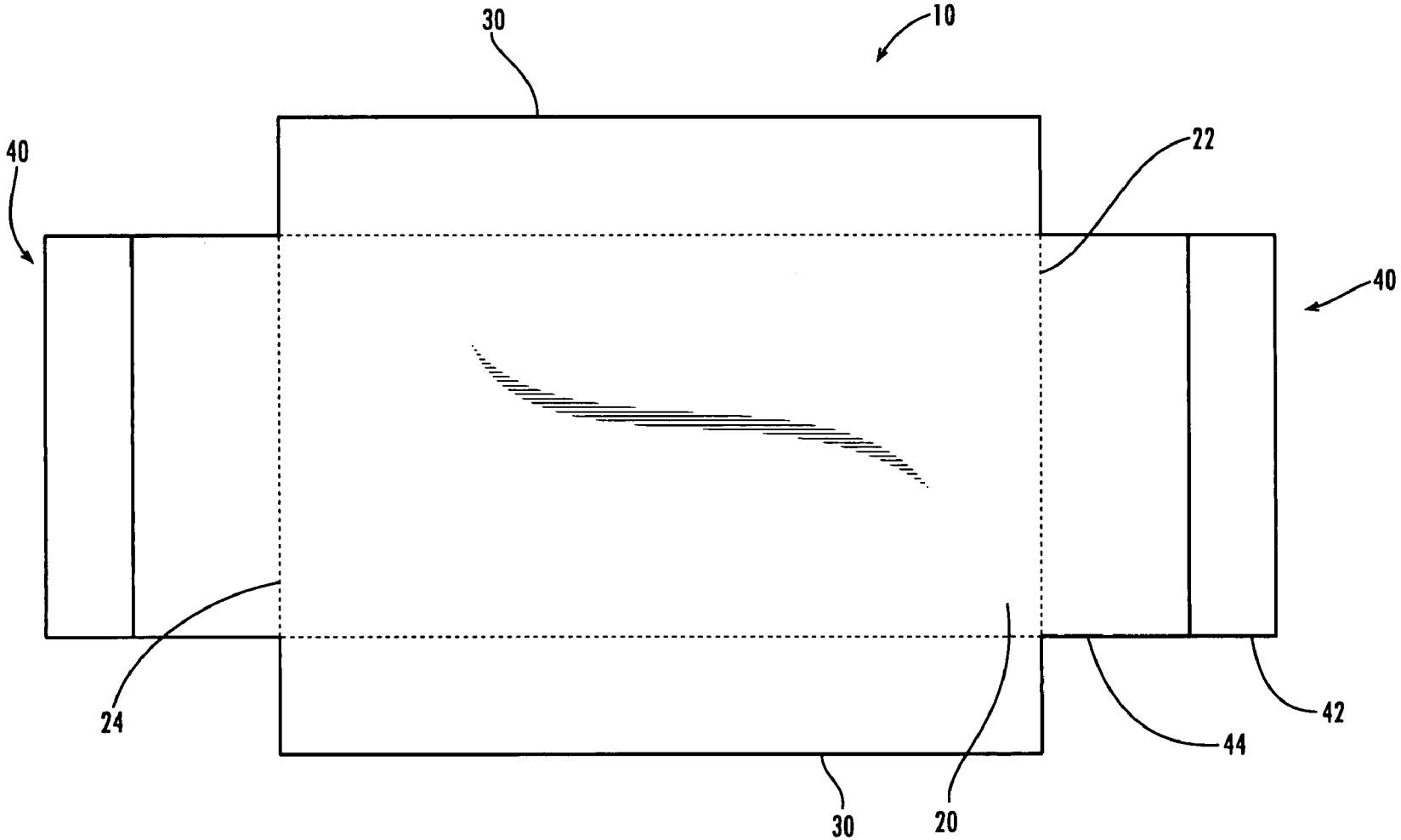
FIG. 1 is a plan view of a pattern of a preferred embodiment of a deep pocket sheet of the present invention.
Figure 2:
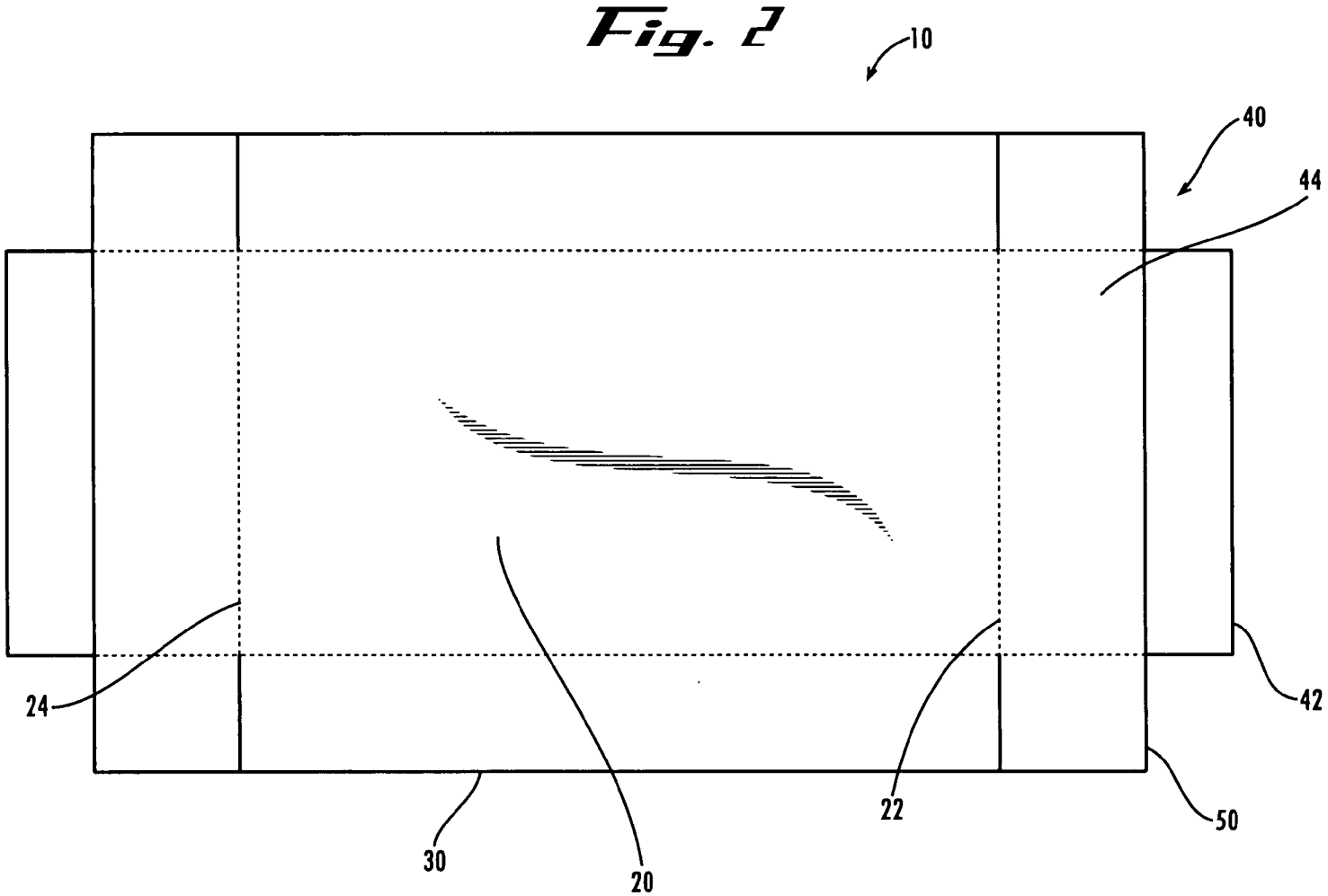
FIG. 2 is a plan view showing another embodiment of a pattern of the deep pocket sheet.
Figure 3:
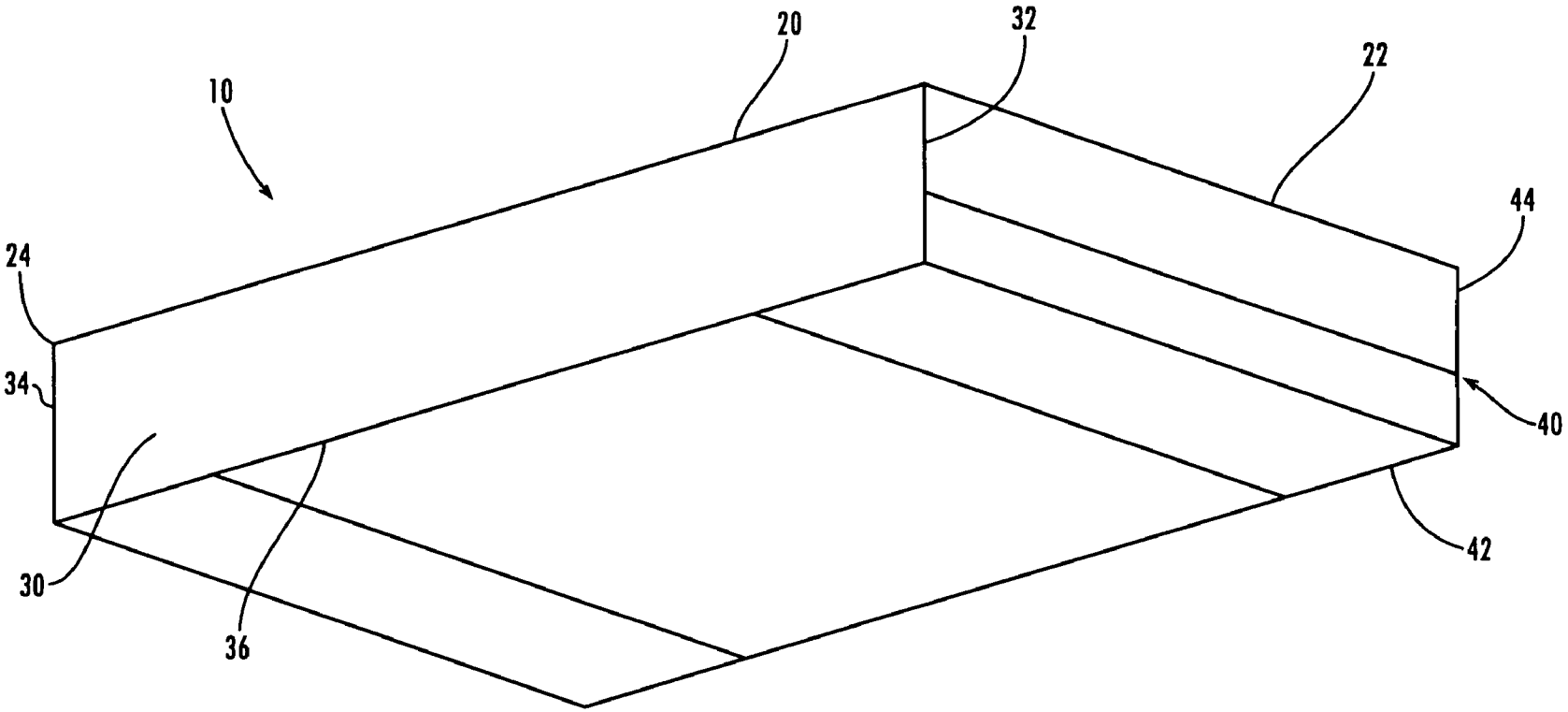
FIG. 3 is a perspective view of the deep pocket sheet as applied to a mattress according to a preferred embodiment of the present invention.

FIG. 1 of the drawings shows a preferred embodiment of an unstitched pattern for a fitted deep pocket sheet 10 for a mattress. The sheet 10 comprises a rectangular body 20, side panels 30, and pocket panels 40. FIG. 2 of the drawings also shows reinforcement tabs 50 located on an end of the pocket panels 40. FIG. 3 of the drawings shows a preferred embodiment of the fitted deep pocket sheet 10 after the pattern of either FIG. 1 or FIG. 2 has been stitched and folded about a mattress. The sheet 10 can be similar in construction and size to standard bed or crib sizes.

The rectangular body 20 of the sheet 10 shown in FIG. 1 and FIG. 2 has a head end 22 and a foot end 24. The rectangular body is constructed of a generally soft, washable, and non-flammable material such as fleece. The material may be printed on one side to avoid unnecessary expense. The rectangular body may also incorporate a trim around the periphery constructed of trim tape or nylon binding.

The side panels 30 shown in FIGS. 1 and 2 are connected to the rectangular body 20 adjacent to the head end 22 and foot end 24. The side panels 30 can be either constructed from a piece of cloth unitary with the rectangular body 20, or constructed of separate pieces of cloth and attached to the rectangular body 20 by a suitable means, such as with bias tape, glue or another adhesive, machine or hand stitching, or a binding means with soft, protected edges. The side panels 30 are preferably of a width sufficient to cover at least a portion of the side of a mattress, such that an infant would be unable to grasp and lift or remove the sheet 10 from the mattress. The side panels 30 can be constructed from a fabric less expensive than fleece, such as cotton or a cotton blend.

As shown in FIG. 3, when sewn to form the three-dimensional deep pocket sheet 10, the side panels 30 are folded at approximately a ninety-degree angle to the rectangular body 20, such that the side panels lay flush against the sides of a mattress. The side panels 30 also have a head end 32, a foot end 34, and a bottom edge 36. Elastic or another stretchable material can be attached to the bottom edge 36 to prevent the side panels 30 from slipping off of the mattress.

Pocket panels 40 shown in FIGS. 1 and 2 are connected to the rectangular body 20 at the head end 22 and foot end 24. In a preferred embodiment, the pocket panels 40 comprise a breathable portion 42, and a connecting portion 44.

The connecting portion 44 can be constructed from a piece of cloth unitary with the rectangular body 20, or constructed of a separate piece of cloth and attached to the rectangular body 20 by a suitable means, such as with bias tape, glue or another adhesive, machine or hand stitching, or a binding means with soft, protected edges. The connecting portion 44 is preferably of a width sufficient to cover at least a portion of the mattress at the head end 22 of the rectangular portion 20 and the foot end 24 of the rectangular portion 20, such that the breathable portion 42 is not readily accessible by an infant or child.

Figure 4:
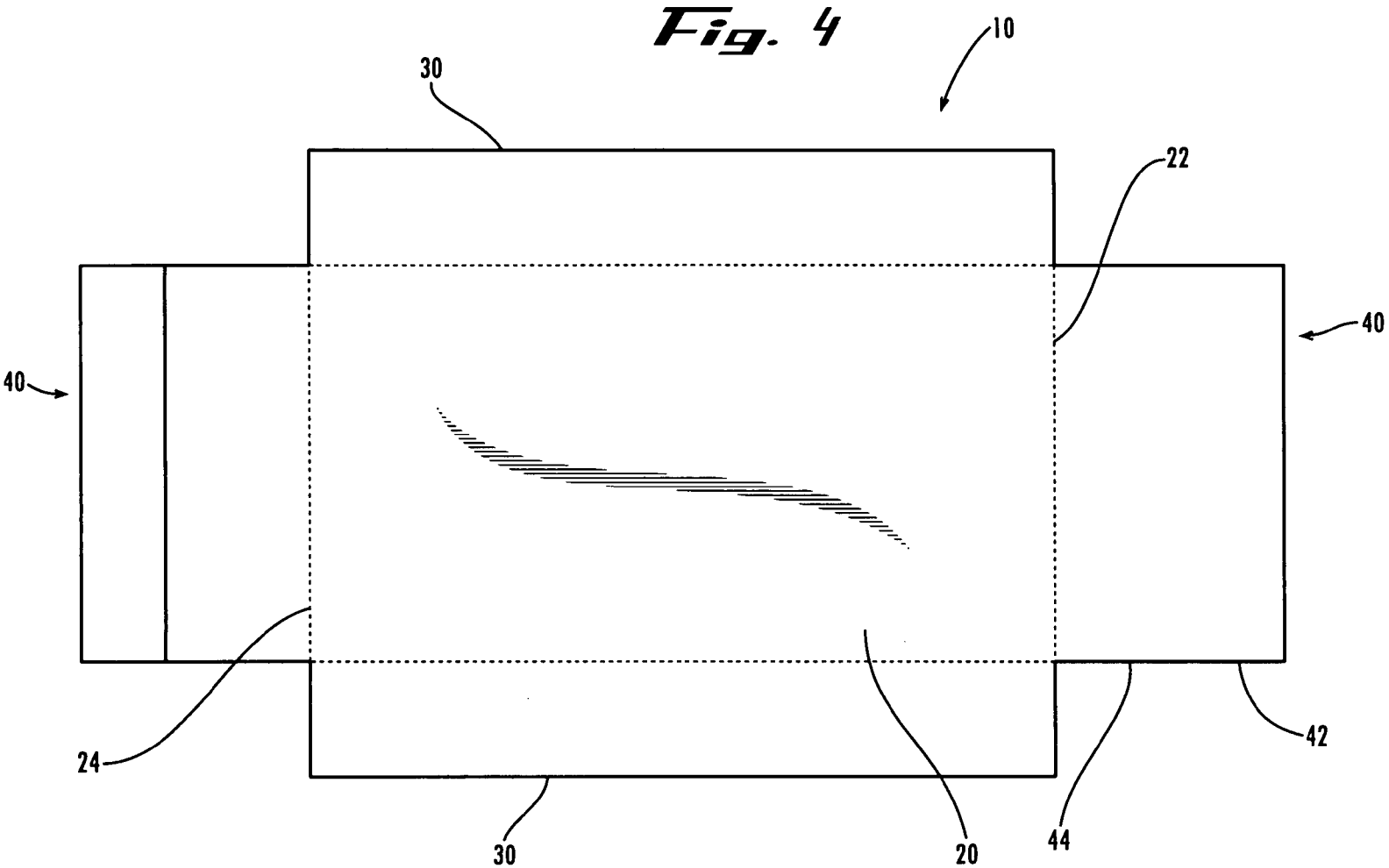
FIG. 4 is a plan view of another embodiment of the present invention.

The breathable portion 42 is connected to the connecting portion 44, and/or can be constructed from a piece of cloth unitary with the rectangular body 20 or the connecting portion 44, as shown in FIG. 4, but is preferably constructed of a separate piece of cloth and attached to the connecting portion by a suitable means, such as with bias tape, glue or another adhesive, machine or hand stitching, or a binding means with soft, protected edges, as shown in FIG. 1. In a preferred embodiment, the breathable portion 42 is constructed from a material that allows an air flow to circulate on both sides of the cloth, thus preventing an infant or child from re-breathing dangerous carbon monoxide if the sheet 10 were to become dislodged from the mattress. The breathable portion 42 also preferably has a vertical give, such that when a mattress is elevated and the edge of the breathable portion 42 is grasped and pulled upward or toward the center of the mattress, the breathable portion 42 will stretch and deform to eventually release the mattress end. This feature allows the sheet 10 to be applied and removed easily, without complete removal of the mattress, while ensuring that a child or infant on the surface of the sheet 10 cannot remove it.

As shown in FIG. 3, when sewn to form the three-dimensional deep pocket sheet 10, the pocket panels 40 are folded twice: once at the head end 22 of the rectangular body 20 to form a ninety-degree angle between the connecting portion 44 and the rectangular body 20, such the pocket panel connects to the head portion 32 of the side panel 30, and again at the bottom edge 36 of the side panel 30, such that the fold creates a ninety-degree angle with the previously folded portion, and is generally parallel to the rectangular body 20.

The pocket panels 40, when stitched, envelop at least one-quarter of the distance from the head end 22 or foot end 22 of the rectangular body 20 to the center of the rectangular body 20. This construction ensures that a child or infant cannot dislodge the sheet, and that the sheet can be washed without danger of lessening the capacity of the sheet to fit a mattress securely.

FIG. 2 of the drawings shows reinforcement tabs 50, which are constructed from a piece of cloth unitary with the connecting portion 44. Reinforcement tabs 50, when sewn to form the three-dimensional sheet 10 of FIG. 3, are folded at a ninety-degree angle to the connecting portion 44, and overlap the side panels 40 on the inside of the sheet, which will touch the mattress. The reinforcement tabs 50 help to strengthen the stitched corners of the sheet 10, and eliminate the need to use bias tape at these seams.

The stitched sheet 10 of FIG. 3 can be serge or over-lock stitched, but is preferably double-folded then stitched, or a binding tape should be incorporated. Over-lock stitching can tighten or distort edges. If a double-fold folder is installed onto the sewing machine, the operator can feed the edging into the folder and stitch much more quickly.

In a preferred embodiment, an absorptive pad or a base sheet can be joined, by sewing, to the rectangular surface 20 of the sheet 10. It is therefore appreciated that the fitted sheet 10 is readily adaptable to be manufactured in a variety of configurations to suit a particular application and consumer need without departing from this disclosure. Furthermore, the fitted sheet 10, may be made available in various sizes and may be readily adapted to fit a wide range of mattresses.

In another embodiment, the sheet 10 can also be secured by the deep pockets 40 to the mattress on only one side, so that one end is either free or more loosely fitted, as the needs of the user dictate. The sheet 10 can also have no side panels 30, such that the rectangular surface 20 only extends to the top edges of the mattress. The shapes of the sheet 10 can be standard rectangular shapes, or can take the form of numerous other embodiments such as round, square, cylindrical and others.

Dimensions of sheets range from standard crib mattresses (approximately 28 inches by 52 inches by 9 inches); newborn intensive care unit isolets (approximately 20 inches by 26 inches by 6 inches); play pens (approximately 27 inches by 39 inches); and standard adult size mattresses (twin, approximately 39 inches by 75 inches by 9 inches; full, approximately 54 inches by 75 inches by 9 inches; queen, approximately 60 inches by 80 inches by 9 inches; king, approximately 76 inches by 80 inches by 9 inches; California king, approximately 72 inches by 84 inches by 9 inches).

In yet another preferred embodiment, the sheet 10 is releasably secured to a mattress by a zipper, a hook and loop fastener, buttons or other securing type of fasteners in lieu of a stretchable fabric. As disclosed, it is apparent that the present invention can provide other covering, fastening and decorative options for use on various mattresses or structures and may be useful for incapacitated or bedridden persons as for infants and small children.

The sheet 10 is preferably constructed from non-flammable polyester material. Other embodiments of the present invention involve the use of slip covers or plastic sheets in place of standard cloth fitted sheets. The rectangular surface 20 of the sheet 10 can also comprise duvet covers or feather beds.

Numerous characteristics and advantages have been set forth in the foregoing description, together with details of structure and function. The disclosure, however, is illustrative only, and changes can be made without departing from the principle of the invention. The scope of the invention, therefore, is to be determined only by the following claims.

What is claimed is:

1. An improved fitted crib sheet comprising:

a body having a head end and a foot end;

side walls adjacent to said head end and said foot end of said body downwardly extending perpendicularly from said body;

a pocket portion connected at said head end and said foot end, having a first wall downwardly extending perpendicularly to said body, and having a second wall extending perpendicularly to said first wall and inwardly to said body, whereby said second wall is generally parallel to said body; and at least one reinforcing tab connected to said pocket portion at said head end and said foot end;

wherein at least a portion of said side walls are trimmed in an elastic material, such that said side walls are secured to a mattress.

2. The improved fitted crib sheet of claim 1, wherein said body is generally rectangular.

3. The improved fitted crib sheet of claim 1, wherein said body comprises a non-flammable polyester material.

4. The improved fitted crib sheet of claim 1, wherein said body comprises fleece.

5. The improved fitted crib sheet of claim 1, wherein said body comprises a material printed only on one side, said printed side facing away from a mattress.

6. The improved fitted crib sheet of claim 1, wherein said pocket portion at said head end and said foot end is double-folded and stitched with bias tape trim.

* * * * *